US005929812A

United States Patent [19]

Aminzadeh

[11] Patent Number: 5,929,812

[45] Date of Patent: Jul. 27, 1999

[54] FLAT ANTENNA

[75] Inventor: Mehran Aminzadeh, Braunschweig, Germany

[73] Assignee: FUBA Automotive GmbH, Bad Salzdetfurth, Germany

[21] Appl. No.: 08/966,500

[22] Filed: Nov. 7, 1997

[30] Foreign Application Priority Data

Nov. 8, 1996 [DE] Germany ..... 196 46 100

[51] Int. Cl.[6] ..... H01Q 1/38; H01Q 1/32

[52] U.S. Cl. ..... 343/700 MS; 343/846; 343/713

[58] Field of Search ..... 343/700 MS, 846, 343/848, 702, 713, 829, 830; H01Q 1/38, 1/32

[56] References Cited

U.S. PATENT DOCUMENTS

| | | | |
|---|---|---|---|
| 4,907,006 | 3/1990 | Nishikawa et al. | 343/700 MS |
| 5,061,939 | 10/1991 | Nakase | 343/700 MS |
| 5,121,127 | 6/1992 | Toriyama | 343/700 MS |
| 5,124,714 | 6/1992 | Harada | 343/713 |
| 5,291,210 | 3/1994 | Nakase | 343/700 MS |
| 5,402,136 | 3/1995 | Goto et al. | 343/700 MS |

FOREIGN PATENT DOCUMENTS

| | | |
|---|---|---|
| 0 537 548 | 4/1993 | European Pat. Off. . |
| 0 740 361 | 10/1996 | European Pat. Off. . |
| 195 04 577 | 8/1996 | Germany . |
| 296 06 475 | 8/1996 | Germany . |
| 5-90828 | 4/1993 | Japan . |

OTHER PUBLICATIONS

Z.D. Liu and P.S. Hall "Dual–band antenna for hand held portable telephones"; *Electronics Letters*, Mar. 28, 1996, vol. 32, No. 7, pp. 609–610.

*Primary Examiner*—Hoanganh Le
*Attorney, Agent, or Firm*—Collard & Roe, P.C.

[57] ABSTRACT

The invention consists of a flat mobile antenna for frequencies in the GHz-range. The flat antenna comprises first and second partial surface segments made from electrically conductive material, and separated from each other by a gap. The antenna also comprises a ground plane surface spaced substantially parallel to, and arranged below the first and second partial surface segments. The first and second partial segments are connected to the ground plane surface by two short-circuit-like conductors at a right angle. Connected to the second partial segment is a coaxial antenna cable having a center conductor and an outer shield conductor. The outer shield conductor is connected to the ground plane surface, and the center conductor is connected to the second partial surface segment at an input feed point, forming a galvanic connection. Connected to and extending out on either side of the second partial surface segment are short strip-like segments or tabs which are connected to the center conductor of the antenna coaxial cable to serve to match the impedance in the feed point.

6 Claims, 3 Drawing Sheets

FLAT ANTENNA

BACKGROUND OF THE INVENTION

1. Field of the Invention

The invention relates to flat antennas for land based signals and radio connections in the Ghz range. In particular, the invention relates to mobile radio transmission in the 900 MHz and 1.8 GHz-bands.

2. The Prior Art

The invention is based on an operating principle disclosed in part in German patent application No. 1 95 045 77. Essentially, the prior art discloses two flat elements made of electrically conductive material aligned parallel to each other. These flat elements are connected by a lateral short circuit. One of the flat elements is a ground plane or reference surface and is connected to an external conductor, coupled to a coaxial cable, while the other element is a "surface segment" and is connected to the center conductor of the coaxial cable. The contours and dimensions of the surface segment determine its function. The elements, when coupled together, form a cavity resonator during operation. During resonance, there is a field buildup in the open lateral zones, causing a radial radiation pattern of a large order of magnitude. If the ground plane is sufficiently larger than the surface segment connected to the coaxial center conductor, or if it is directly positioned above a larger conductive surface, then a radiation pattern is produced similar to that of a monopole.

In addition, German Patent Application No. 1 96 14 068 discloses a flat antenna with a ground plane having sides that arch towards the edge in one coordinate. For example, if the ground plane is designed in the form of a flat trough or cap-shaped surface, the dimensions of the ground plane can be reduced without impairing the function of the antenna and its radiation parameters.

Extensive tests reveal that good antenna gains are achieved by changing the design of the ground plane. For example, if the ground plane is redesigned so that it arches on both sides toward the edge in at least one coordinate, then these better gains can be achieved. Another way is to redesign the ground plane in the form of a flat trough or cap shaped surface, where the dimensions of the ground plane can be reduced without impairing the function of the antenna and its radiation parameters.

The antenna principle described above has one drawback in that it requires approximately symmetrical conditions when two antenna components are mounted, i.e. the antenna surface segment has to be disposed above the ground plane as centrally as possible. This requirement leads problems when these antennas are mounted on automobiles.

The flat antenna can be mounted on a vehicle in one of two ways. It can be mounted either as an external attachment part on the outside of the vehicle, or on the interior of the vehicle below the front or rear windshield. If the antenna is mounted on the rear window, then the dimensions of the ground plane are reduced using a spherical design. This design is referred to above in part in German Patent Application 196 14 068. However, this design is insufficient since the rear window in many cases is slanted off from the horizontal plane, so that the radiation characteristic of the antenna appears as a circle displaced in the direction of the rear of the vehicle. Thus, the radiation level is somewhat weaker in the direction of the front of the vehicle.

Therefore, the invention provides a way of improving the operating parameters of flat antennas to allow for different installation positions, and for greater flexibility.

SUMMARY OF THE INVENTION

It is therefore an object of the present invention to provide an improved radiation characteristics for a flat antenna and to ensure omni-directional radiation even under operating conditions that are normally unfavorable for this type of radiation.

It is also another object of the invention to provide a flat antenna that produces a high gain, regardless of any structural modifications.

It is yet another object of the invention to overcome the drawbacks of the prior art and to provide a flat antenna that is efficient, effective in use, reliable in operation, and at low cost.

These and other related objects are achieved according to the invention by providing a flat antenna for frequencies in the GHz-range. For example, the variation of the radiation characteristics is made possible by dividing the surface section into equal halves, while retaining the length of $\lambda/4$. With minor changes in the division ratio as well as in the width of the gap, or by overlapping part of the surface segments, it is then possible to make supplemental corrections.

To achieve this goal, the invention comprises a surface segment made from electrically conductive material that is divided into a first partial surface segment and a second partial surface segment. The antenna also comprises a material, that has a larger surface area and is spaced substantially parallel to, and below the first and second surface segments.

When the ground plane is connected to the first and second surface segments, there are two short-circuit-like conductive connections that connect each part of the surface segment to ground. In addition, an antenna cable has both an inner or center conductor, and an outer conductor which feed both the ground plane and the surface segment. The center conductor is connected to the second surface segment, and the outer conductor is connected to ground.

In another embodiment of the invention, the first part of the surface segment overlaps the second surface segment, and there is a dielectric disposed between the overlapping segments. In addition, the second surface segment connected to the center conductor is approximately one quarter of the wavelength ($\lambda/4$) of the median operating frequency range.

In still another embodiment of the invention, the short-circuit of the first surface segment is preferably not perpendicular, but made at an obtuse angle.

Finally, the flat antenna can be placed in combination with an antenna for a higher frequency, such as a combination with an antenna for a higher frequency, such as a patch antenna, whereby the first and second surface segments and their corresponding short circuit connections form the ground plane for the patch antenna.

With the improvements according to the invention, it is possible to correct the radiation characteristic of the antenna as described in part in German Patent Application 195 14 168, to provide an almost complete omni-directional radiation pattern. In addition, the antenna is well adapted when divided with the linear pieces.

It is noted that good to excellent radiation patterns were obtained for radio communication with all design variations shown herein, and also for operating on an additional frequency with the combination of two antennas.

BRIEF DESCRIPTION OF THE DRAWINGS

Other objects and features of the present invention will become apparent from the following detailed description considered in connection with the accompanying drawings, which disclose the embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENT

Figure 1A:
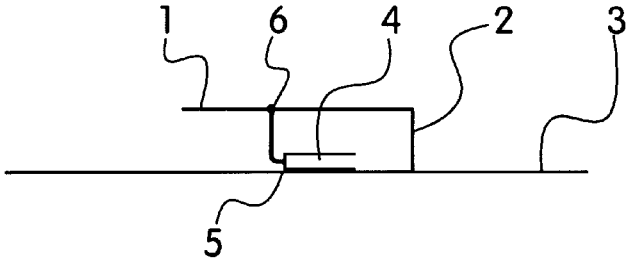
Fig. 1a (Prior Art)
FIGS. 1*a* and 1*b* are embodiments of the prior art showing the front surface of a flat antenna.
Figure 1B:
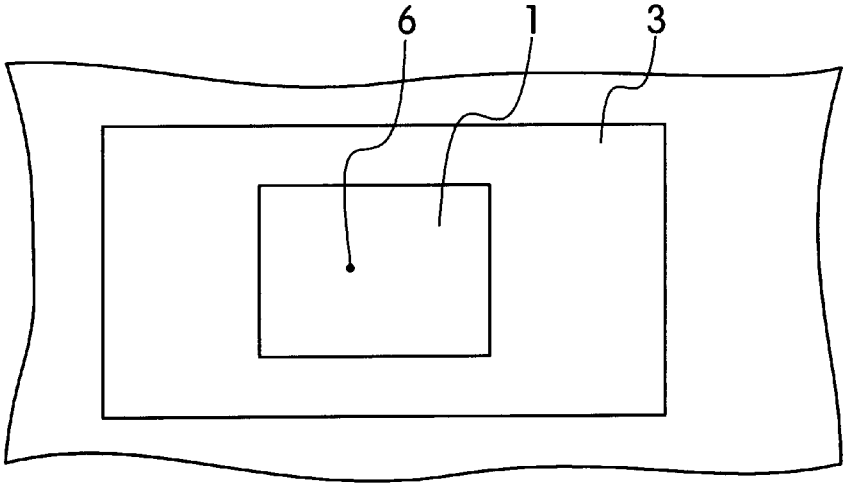
Fig. 1b (Prior Art)

Referring to FIGS. 1*a* and 1*b* there is shown the basic structure of an antenna of the prior art. The antenna consists of a sheet metal segment 1, a bridge 2 serving as a short circuit connection to a sheet metal plate 3 serving as a ground plane. Coaxial feed cable 4 has its outer shield connected at point 5 to sheet metal plate 3, and its center conductor 6 to metal segment 1.

For an operating frequency range of 900 MHz the characteristic antenna dimensions are obtained if sheet metal segment 1 is 76×87 mm, and the spacing between sheet metal segment 1 and sheet metal plate 3 is 13 mm. Also, sheet metal plate 3 is 254×332 mm.

The data for sheet metal plate 3 are for minimum dimensions. An additional and larger flat element of conductive material is located below the sheet metal plate.

Figure 2:
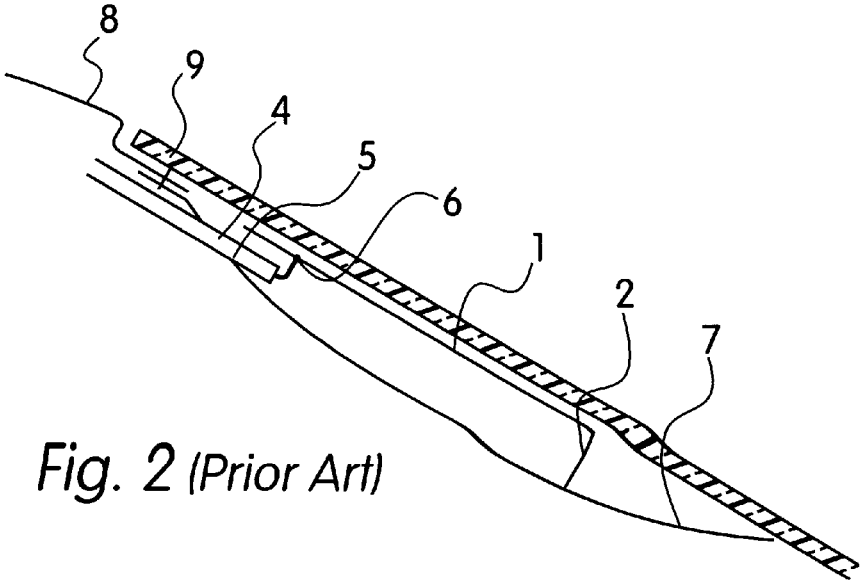
Fig. 2 (Prior Art)
FIG. 2 is an embodiment of the prior art showing a flat antenna with a cap-like ground reference surface.

FIG. 2 shows a prior art design according to the aforementioned German application No. 196 14 068. Here, the ground plane surface, has its edge bent upward on all sides, and is in the form of a flat cap 7. On one side, cap 7 is conductively connected to ground 8, that is, to the metallic edge of the roof above rear window 9 of the motor vehicle. The dimensions of the cap are reduced to one fourth of the length of ground reference surface 3 according to FIG. 1. In this design, except for the aforementioned differences in level along the longitudinal axis of the vehicle, no impairments of the antenna parameters were found in comparison with the antenna of FIG. 1.

Figure 3A:
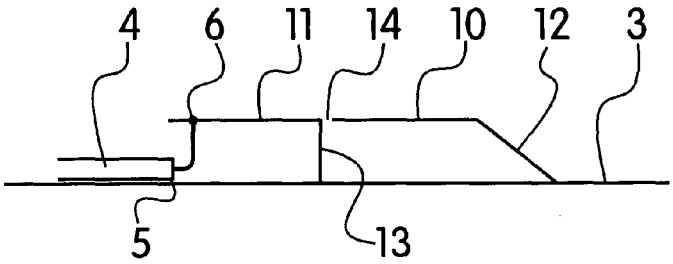
FIG. 3*a* shows a side profile view of the flat antenna according to the invention.
Figure 3B:
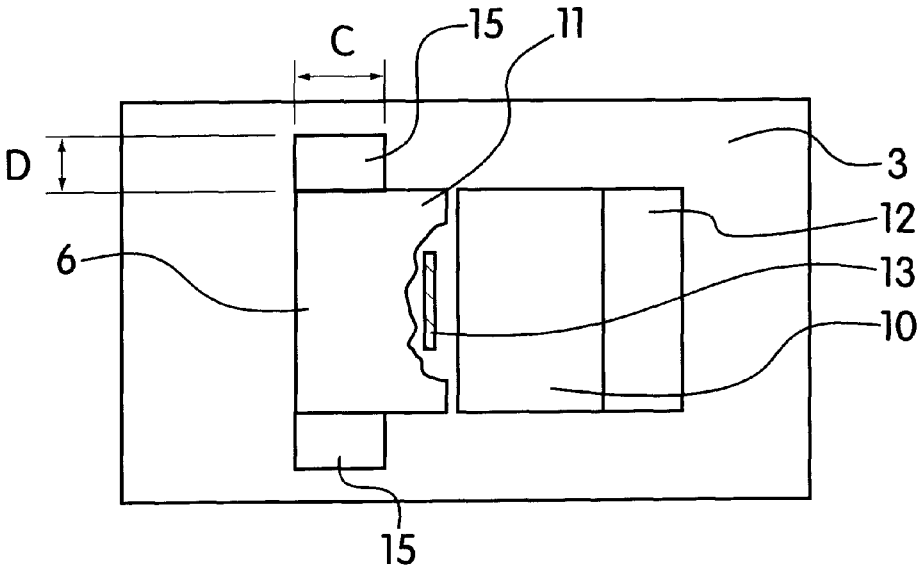
FIG. 3*b* shows a top view of the antenna of FIG. 3*a;*
Figure 3C:
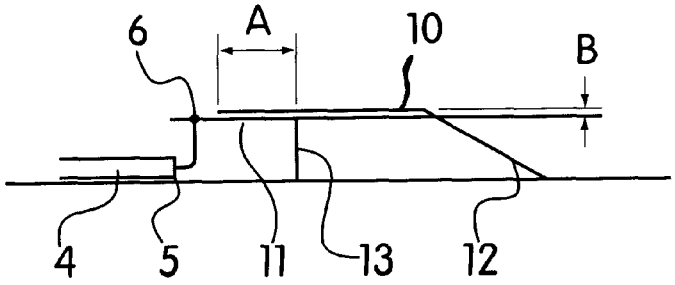
FIG. 3*c* shows another embodiment of the antenna of FIG. 3*a* with overlapping antenna surfaces.
Figure 4:
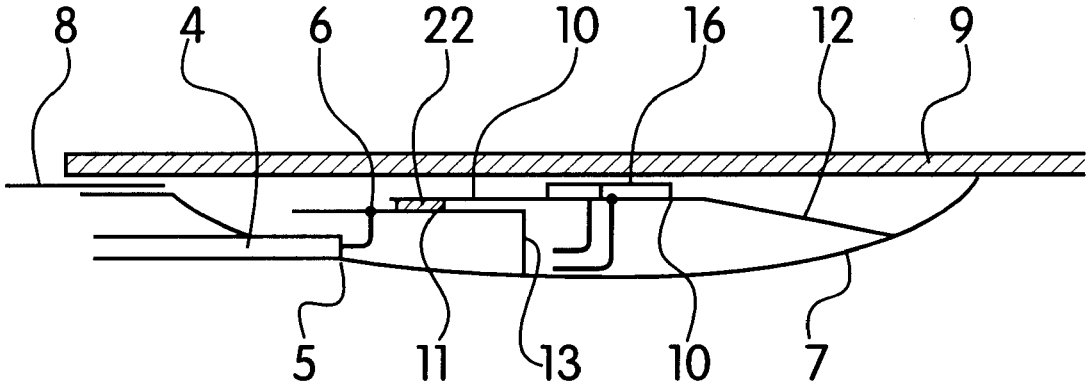
FIG. 4 shows the antenna according to the invention for radio communication with cap-like ground plane surface, in combination with a patch antenna for satellite reception.

FIGS. 3*a*, 3*b* and 3*c* show an embodiment of the present invention. The antenna consists of a first partial surface segment 10 and a second partial surface segment 11, in which each are connected to ground plane surface via separate bridges 12 and 13 and serving as short-circuit connections. In the variation shown in FIGS. 3*a* and *b,* the width of gap 14 is selected so that it does not interfere with the field corresponding with the operating frequency, and that a through-extending surface is present for the field. As shown in FIG. 4, a dielectric 22 is placed on second partial surface segment 11 below first partial surface segment 10 to keep second partial surface segment 11 separated from first partial surface segment 10. In addition, the same result is obtained by overlapping partial surfaces 10 and 11 and shown in FIG. 3*c*.

Furthermore, the electrical properties of the antenna can be controlled by varying the width of gap 14, as well as the dimensions A and B of the overlapping surface segments, and, the relative dielectric constant of the dielectric within the zone of the overlap. Section 15 is attached to second partial surface segment 11 and can serve to match the cable impedance by varying dimensions C and D as shown in FIG. 3*b*.

In another embodiment of the invention, FIG. 4 provides a flat antenna having a ground plane surface 17 with reduced dimensions in combination with an antenna 21 for another frequency range. Here a flat antenna for radio communication, according to the invention, e.g. in the 900 MHz-range, is combined with an antenna 16 for satellite-supported motor vehicle navigation, such as a GPS antenna.

In this embodiment, bridge 12 is the short-circuit connection of first partial surface 10, and is adjacent to the partial surface on an obtuse angle, so that the larger ground surface was favorably obtained in a simple way for the function of patch antenna 16.

This arrangement is suitable for positioning below a cover or flat construction element made of a dielectric material, regardless of whether vehicle windshield 9 or roof 8 or the hood are made of plastic material or not.

It is emphasized that good to excellent radiation characteristics were obtained for radio communication with all of the design variations shown herein, and also for operating on an additional frequency with a combination of two antennas.

Accordingly, while a few embodiments of the present invention have been shown and described, it is obvious that many changes and modifications may be made thereunto without departing from the spirit and scope of the invention.

What is claimed is:

1. A flat antenna for receiving and transmitting radio frequencies in the GHz-range for a vehicle comprising:

a first partial surface segment made from electrically conductive material;

a second partial surface segment made from electrically conductive material separated from said first partial surface segment by a gap;

a ground plane surface made from electrically conductive material having a larger surface area than said first and said second partial surface segments, said ground plane surface being spaced substantially parallel to, and disposed below the first and second partial surface segments;

only two short circuit like conductive connections that connect both said first partial surface segment and said second partial surface segment to said ground plane surface;

a coaxial cable having a center conductor and an outer shield conductor, the outer conductor being connected to said ground plane surface, and the center conductor being connected to said second partial surface segment at a feed point forming a galvanic connection, wherein said first partial surface segment is capacitively coupled to the second partial surface segment by the gap between said two surface segments; and strip like line pieces connected to and extending out on either side of said second partial surface segment and being connected to the center conductor of said coaxial cable for matching the impedance of the antenna to the feed point of said coaxial cable.

2. The flat antenna according to claim 1, wherein a first part of said first surface segment overlaps a second part of said second surface segment in a parallel manner, and further comprising a dielectric located in between the first part and the second part of said segment.

3. The flat antenna according to claim 1, wherein the short-circuit connection of the first partial surface segment is made at an obtuse angle.

4. The flat antenna according to claim 1, further comprising a patch antenna for receiving signals at a higher frequency, said patch antenna disposed on said first partial surface segment, wherein said first partial surface segment and a short circuit connection connected to said first partial surface segment form a ground surface segment for the patch antenna.

5. The flat antenna according to claim 1, wherein said first partial surface segment and said second partial surface segment have a total length which is measured between an outer short circuit connection to said first partial surface segment, and an opposite outer edge of said second partial surface segment, which is equal to a quarter wavelength of the antenna's median operating frequency.

6. The flat antenna according to claim 1, wherein the short circuit connection of the first partial surface segment is made at a right angle.

* * * * *